US007794336B2

(12) United States Patent
Wu et al.

(10) Patent No.: US 7,794,336 B2
(45) Date of Patent: Sep. 14, 2010

(54) BALL TRAINING APPARATUS

(76) Inventors: Siu Fun Bonnie Wu, Room 330-331 Myloft, 9 Hoi Wing Road, Tuen Mun, New Territories (HK); Kim Yong Leong, Room 330-331 Myloft, 9 Hoi Wing Road, Tuen Mun, New Territories (HK)

( * ) Notice: Subject to any disclaimer, the term of this patent is extended or adjusted under 35 U.S.C. 154(b) by 0 days.

(21) Appl. No.: 12/218,870

(22) Filed: Jul. 18, 2008

(65) Prior Publication Data

US 2009/0075763 A1 Mar. 19, 2009

(30) Foreign Application Priority Data

Jul. 20, 2007 (CN) ..... 2007 2 0153232 U
Feb. 25, 2008 (CN) ..... 2008 2 0007720 U

(51) Int. Cl.
*A63B 69/00* (2006.01)

(52) U.S. Cl. ..... 473/424

(58) Field of Classification Search ..... 473/423, 473/424, 429, 430, 576; 403/211, 378–379.6; 24/136 R, 136 K, 136 L, 115 K, 115 R, 115 H
See application file for complete search history.

(56) References Cited

U.S. PATENT DOCUMENTS 3,351,343 A * 11/1967 Papp ..... 473/430
4,071,241 A * 1/1978 Cortes Garcia ..... 473/424
4,147,353 A * 4/1979 Moore ..... 473/575
4,247,117 A * 1/1981 Reichert ..... 473/424
4,687,209 A * 8/1987 Carey ..... 473/424
5,094,462 A * 3/1992 Boyle et al. ..... 473/576
5,401,034 A * 3/1995 Mallinger ..... 473/576
5,575,481 A 11/1996 Lovetere et al.
5,586,760 A * 12/1996 Hauter ..... 473/424
5,620,186 A * 4/1997 Dudley ..... 473/423
5,669,837 A 9/1997 Hauter
5,951,414 A * 9/1999 Sowards ..... 473/423
6,168,539 B1 * 1/2001 Maina ..... 473/424
6,352,484 B1 * 3/2002 Killion ..... 473/424

(Continued)

FOREIGN PATENT DOCUMENTS

CN 2511338 9/2002

(Continued)

OTHER PUBLICATIONS

International Search Report dated May 28, 2009 of International Application No. PCT/CN2009/070490.

*Primary Examiner*—Mark S Graham
(74) *Attorney, Agent, or Firm*—Law Office of Sergel Orel, LLC

(57) ABSTRACT

A ball training apparatus comprising: a ball; a ball-holding net to wrap around the ball; a tether cord that is connected to the net; a cord handle and cord length adjuster that is connected to one end of the cord; a spinning connector structure which is installed on the ball-holding net to connect the ball-holding net to the cord and allows the ball to spin relative to the cord. Thus the ball inside the net can rotate freely without intertwining with the tether. The handle of this ball training apparatus can either be attached to the user's waist belt or be held in hand and therefore the user can achieve various training outcomes.

6 Claims, 18 Drawing Sheets

U.S. PATENT DOCUMENTS

Figure 1:
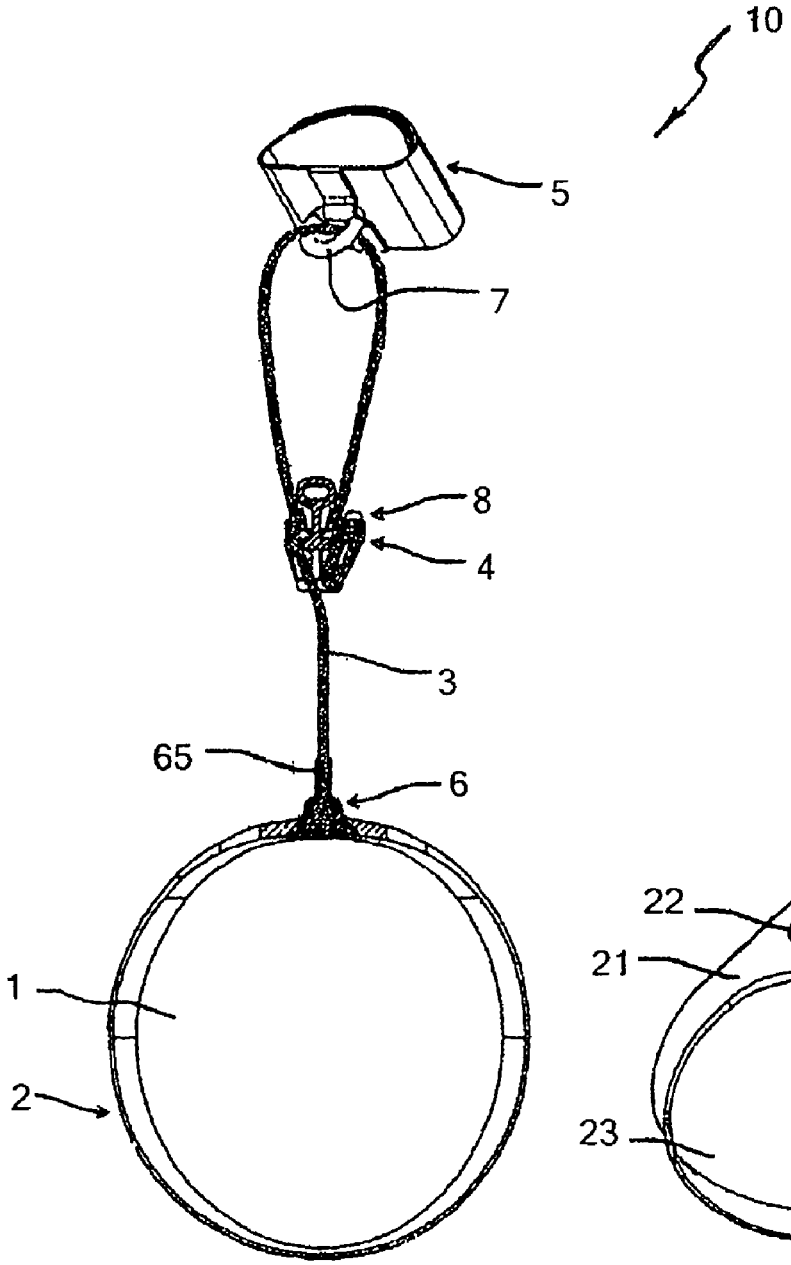

| | | | | |
|---|---|---|---|---|
| 7,527,567 | B2 * | 5/2009 | Ohle | 473/422 |
| 2005/0282664 | A1 * | 12/2005 | Beatty | 473/423 |
| 2006/0183570 | A1 | 8/2006 | Serge et al. | |

FOREIGN PATENT DOCUMENTS

| | | | |
|---|---|---|---|
| CN | 201186135 | | 1/2009 |
| EP | 580309 | A1 | 1/1994 |
| FR | 2741541 | | 11/1995 |
| WO | 9956836 | A1 | 11/1999 |
| WO | 2007016727 | A1 | 2/2007 |

* cited by examiner

BALL TRAINING APPARATUS

This Application claims the benefits of Chinese Patent Applications 200720153232.6 filed 20 Jul. 2007 and 200820007720.0 filed 25 Feb. 2008.

TECHNICAL FIELD

This invention is a ball training apparatus for gaming and aerobic training. Specifically, it has a ball-holding net that can spin freely without being intertwined into the tether. The cord's length can be adjusted.

BACKGROUND

In today's world, every country is trying to improve the nation's health and well being by encouraging sporting activities. With the 2008 Olympics coming to Beijing, the whole of China is embracing the idea of "Faster, Higher, Stronger." Ball games, such as soccer and basketball, are among the more popular sports. In ball games, e.g., soccer, the most important training is the skills to control the ball, pass the ball and shoot it right. In order to gain these skills, one needs to repeat the same move again and again. The issue with repeating the practice is that every time a ball is kicked out, the person needs to retrieve it back before repeating the move being practiced. This becomes even more difficult when training long range shots and passes. Thus a lot of training time is wasted in retrieving the ball and this has a negative impact on the effectiveness of the training.

To resolve this issue, there are many practice tools on the market such as the "game ball training apparatus/carrier" of U.S. Pat. No. 5,083,797. This apparatus mainly includes a net, a handle, a length adjuster and the rope connecting the handle and the net. The net is used to receive and hold the ball. The user holds the handle retaining the cord to control the ball. Thus it is easier to retrieve the ball. The length adjuster has a main body and a movable locker to adjust the length of the cord between the handle and the net.

Another example is the "soccer ball spin training tether" of U.S. Pat. No. 6,168,539. This cord is used in the kicking practice of soccer. It includes a cord that connects the ball and the handle, consisting of elastic strips and non-elastic fine strips. It also has a net to hold the ball, consisting of several longitudinal strips. There is a hole at the place where all the strips meet, i.e., in the north and south poles of the net. The ends of the ropes have a protective covering of wax or plastic. After the cord passes through the hole, it forms a knot at the end of the rope. Thus it is connected to the ball through the hole inside the washer. Thus, the cord can spin freely.

However, those traditional practice balls still have shortcomings in the design and usage. These said shortcomings in usage include:

1. The cords can easily get intertwined. When a ball is kicked, the ball will get into a high speed spin under force. In the "game ball training apparatus/carrier" of U.S. Pat. No. 5,083,797, since the net is connected directly to the cord, when the ball is kicked and starts to spin, the net will start spinning with the ball, thus making the rope and the net intertwined. This will cause difficulties in practicing controlling the ball.
2. The net structure is not flexible. In the "game ball training apparatus/carrier" of U.S. Pat. No. 5,083,797, since the net is not elastic, it is very inconvenient to put the ball into the net. The user has to open the net from top, put the ball inside, and then fasten the top. It is very inconvenient in operating. In the "soccer ball spin training tether" of U.S. Pat. No. 6,168,539, the net structure that is used to hold the ball is comprised of several longitudinal strips. These strips are not elastic either. They can not themselves change the length based on the size of the ball. Thus it is not flexible.
3. The spinning device cannot last long. In the "soccer ball spin training tether" of U.S. Pat. No. 6,168,539, a structure connects the cord to the ball and reportedly makes sure the rope does not intertwine when the ball spins. It uses a rope, whose one end is covered with wax or plastic to protect it and runs through a hollow rivet and washer to tie a knot. Thus, the ball's spinning will not cause the cord to intertwine. However, the wax protection layer is in constant contact with the washer. While the ball keeps spinning, under the pulling force and the spinning motion, the friction between wax protection layer and the washer will wear out the wax, and finally makes the cord fail, impairing the rotation & weakening the structure and eventually causing the ball to possibly fall.

SUMMARY OF THE INVENTION

Thus, to resolve the said issues, the purpose of this invention is to provide a ball training apparatus for gaming and aerobic training. To be more specific, it is a ball training device that allows the ball holding net to spin freely without intertwining the tether, and the length of the cord to be adjusted. Thus the ball can spin freely under force without causing the cord to intertwine, making it easier to control the ball and making the connection between the ball and the cord stronger and more convenient to use.

To achieve these goals, this invention provides a ball training apparatus, including a ball, a ball-holding net to hold the ball; a cord, its one end is connected to the ball-holding net; a cord handle and cord length adjuster, which is connected to the other end of the tether to adjust the length of the cord. This ball training apparatus also includes a spinning connector structure installed on the ball-holding net to connect the ball-holding net and the cord which allows the ball in the ball-holding net to spin freely without intertwining the cord. The ball holding net is elastic and can adjust to fit in balls of different sizes.

In the ball training apparatus, the ball-holding net is preferably made from elastic material. This net preferably consists of elastic longitudinal strips which form the space to hold the ball. In the top (north pole) of the ball holding net there is a hole. This holes' top diameter is smaller than the bottom diameter and coordinates with the spinning connector.

In an embodiment of the ball training apparatus invention, the spinning connector structure includes a ring-shaped washer, having both a flat head cone-shaped surface and a cylindrical-shaped surface with a relatively smaller diameter. The ring-shaped washer is attached from underneath the hole on the ball-holding net. The ring-shaped washer has a concave round bottom and a round base cap that is sealed beneath the ring-shaped washer. In this embodiment, a spinning connector is installed inside the ring-shaped washer. A round disk is located at the bottom of the spinning connector, the round disk coordinates with the concave round bottom so that it can spin freely inside the ring-shaped washer. At the top of the round disk is a cylinder which is connected with the cord.

In an embodiment of the ball training apparatus invention, cuts are made on each parallel side of the top part of the cylinder of the spinning connector to form a shape resembling a pair of extending fans. Close to the cylinder and the round disk there is a passage perpendicular to the central axis of the cylinder. On the same part an arc groove is cut down one side of the fan shaped structure. The groove is tangential and passable to the passage so that a ring buckle on one end of the cord can be inserted. Also on the same part, concave grooves are cut on both remaining circular sides of the twin-fan shaped structure.

In an embodiment of the ball training apparatus invention, the spinning connector can include an elastic vibration reduction cap attaching to the top of the spinning connector, the elastic vibration reduction cap has a flat cylinder and a pair of flat wing shaped extenders. A concave base is formed at the bottom of the flat cylinder, coordinating the contours of the twin-fan shaped structure and the concave grooves on the spinning connector. Cord passages are bored on top of the flat cylinder.

In an embodiment of the ball training apparatus invention, the cord handle and cord length adjuster has an upper half and a lower half, a turn axle installed on the upper half, a pressure spring installed between bottom part of the turn axle and the lower half, and screw fastenings secure the two halves. In the middle of the upper half there is an opening with gradual steps. A stop notch is made in the opening. The turn axle has a flange in several gradual steps which is affixed inside the opening, and can be turned around. The turn axle features a turn knob on top of the flange and a take spool below the flange. One end of the tether, after winding past a passage located at the meeting surfaces of the upper and lower halves, is tied and wound on the take spool. Pushed by the pressure spring, the flange on the said turn axle would reach the opening with gradual steps. It is not able to turn there because of the stop notch.

In some embodiments of the ball training apparatus invention, the cord is elastic.

In other embodiments of the ball training apparatus invention, the cord is not elastic.

In an embodiment of the ball training apparatus invention, the cord handle and cord length adjuster has a pressure clip on the front conjoining side of the upper and lower halves of the cord handle and cord length adjuster. The pressure clip is used to hook the cord handle and cord length adjuster on a user's waist belt.

In an embodiment of the ball training apparatus invention, the cord handle and cord length adjuster has pressure clips on both flanks of the two halves of the cord handle and cord length adjuster. The pressure clips are used to affix an elastic band so a user can hold the cord handle and cord length adjuster in hand.

In an embodiment of the ball training apparatus invention, the apparatus includes a waist belt that is worn by the user. The waist belt can be adjustable to fit users with various sized waists. In certain embodiments of the invention, the cord length adjuster is attached directly to the waist belt thus allowing the user to train with hands free. In certain embodiments, the waist belt includes a pouch which can serve to attach the handle to the waist belt thus also allowing the user to train with hands free. In certain embodiments, the waist belt can include a pouch which can accept the handle and cord length adjuster.

To better understand this invention's goal, characteristics, and advantages, detailed illustration of a feasible implementation of this invention is provided below with figures.

FIGURES

FIG. 1: A dissembled view of this ball training apparatus invention.(First implementation)

Figure 2:
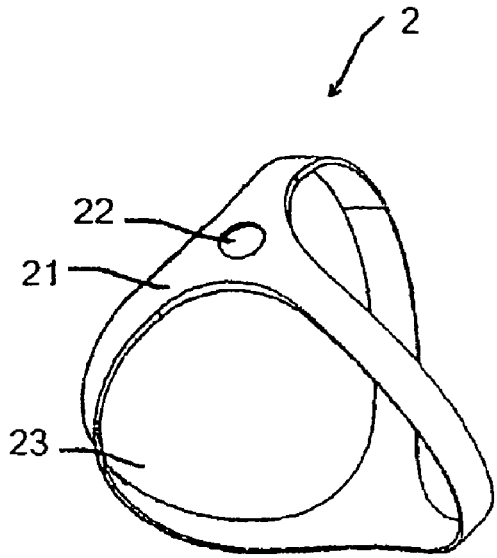

FIG. 2: A three dimensional view of the ball-holding net in FIG. 1.

Figure 3:
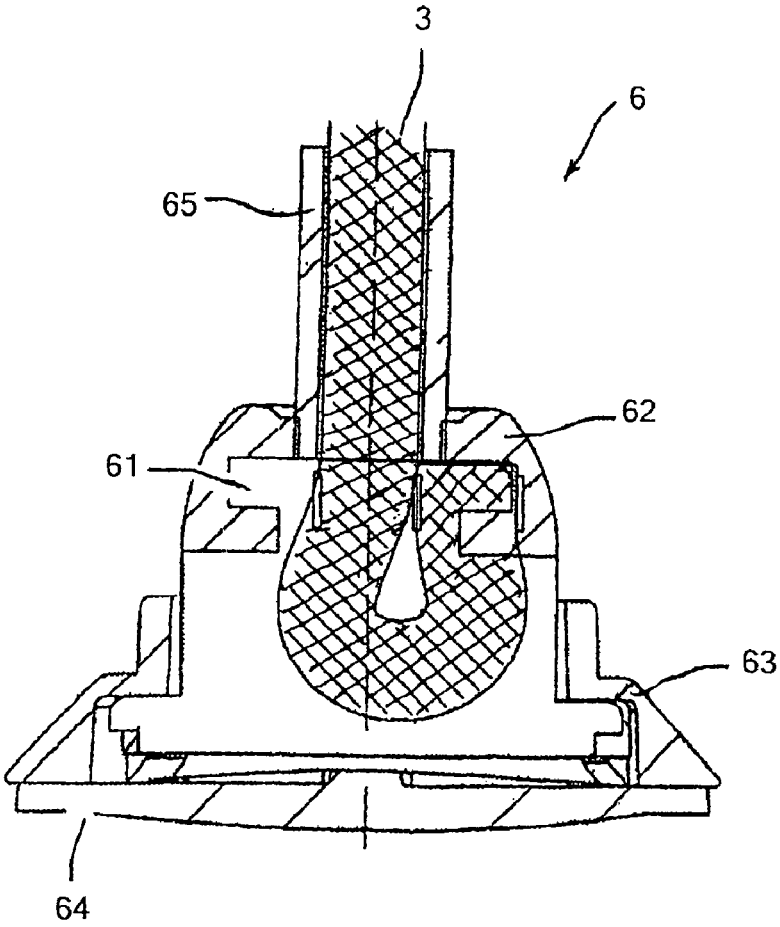

FIG. 3: A dissected view of the spinning connector structure in FIG. 1.

Figure 4:
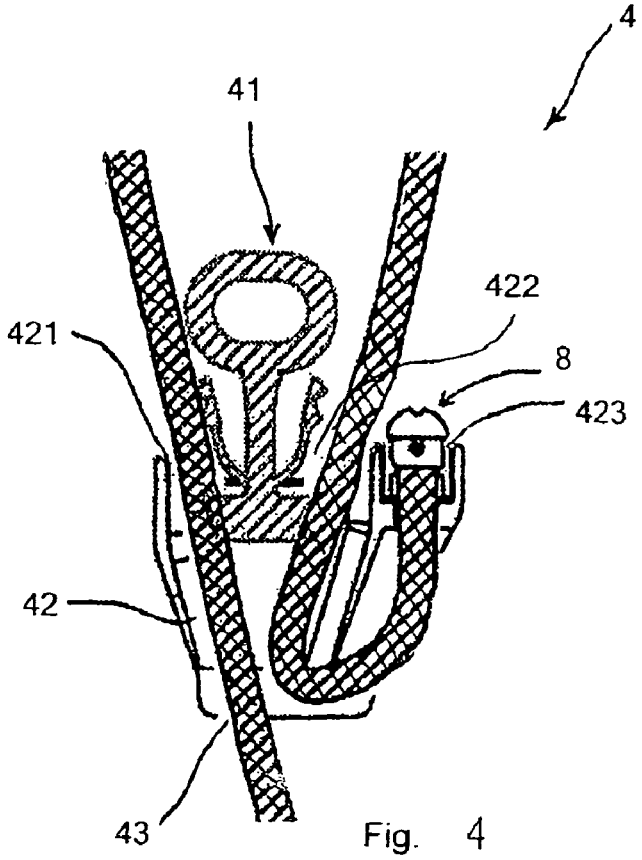

FIG. 4: The inside profile of the cord handle and cord length adjuster.

Figure 5:
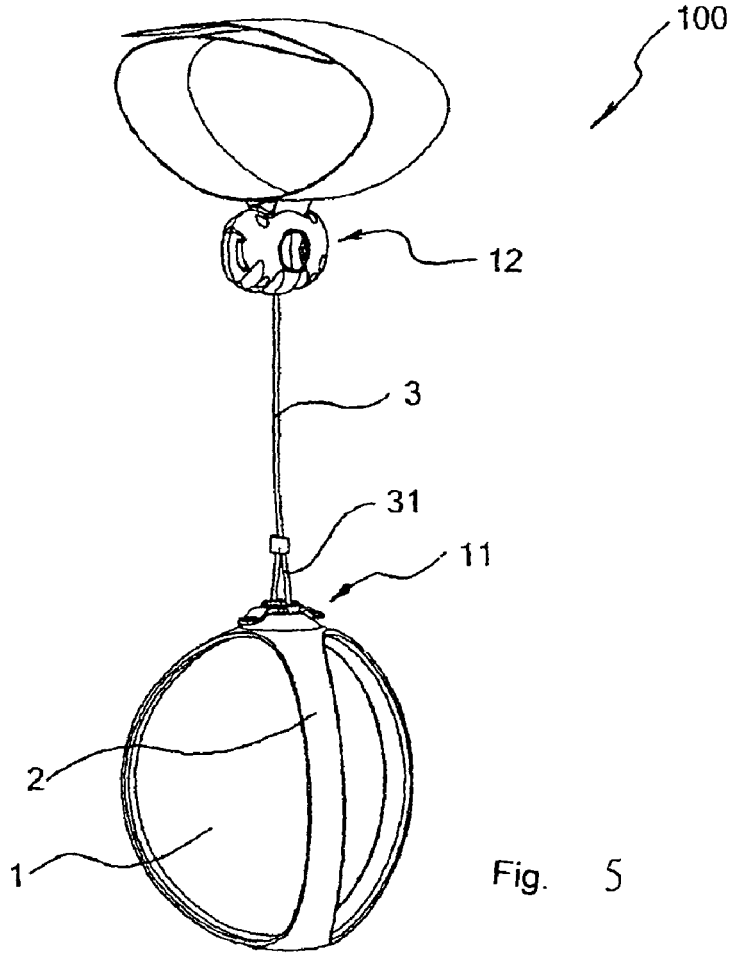

FIG. 5: A dissembled view of this ball training apparatus invention. (Second implementation)

Figure 6:
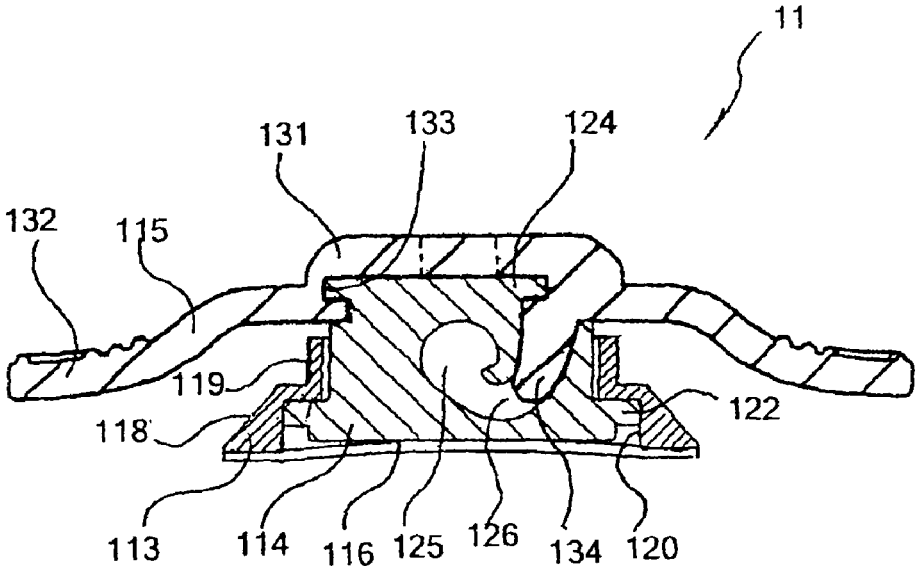

FIG. 6: A dissected view of the spinning connector structure in FIG. 5.

Figure 7:
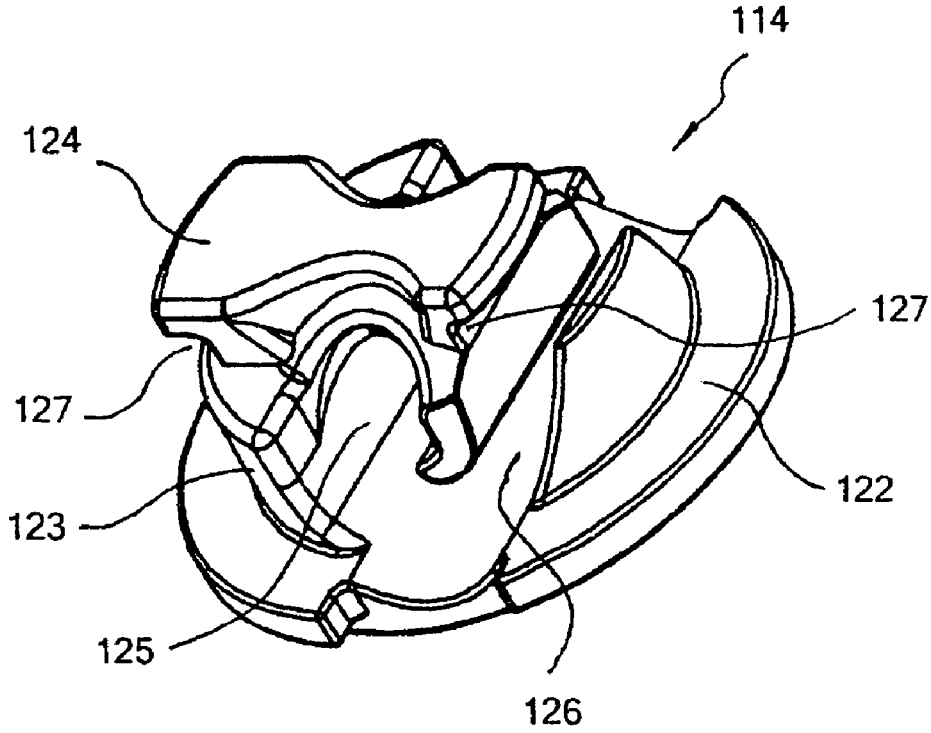

FIG. 7: A perspective view of the cord handle and cord length adjuster in FIG. 5.

Figure 8:
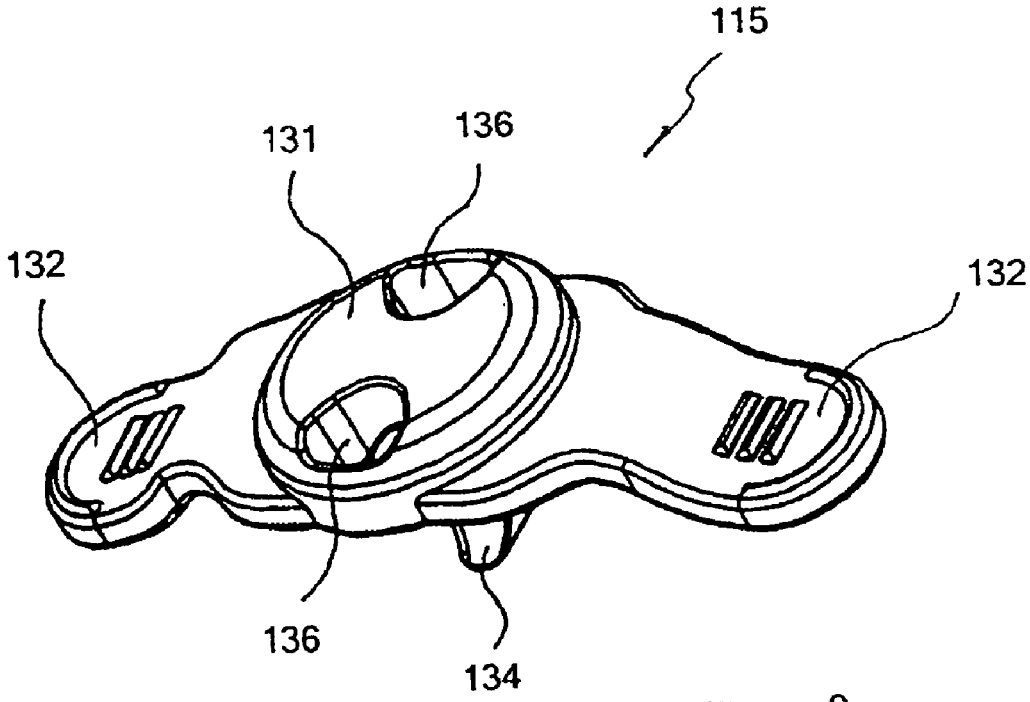

FIG. 8: A perspective view of the elastic vibration reduction cap in FIG. 5.

Figure 9:
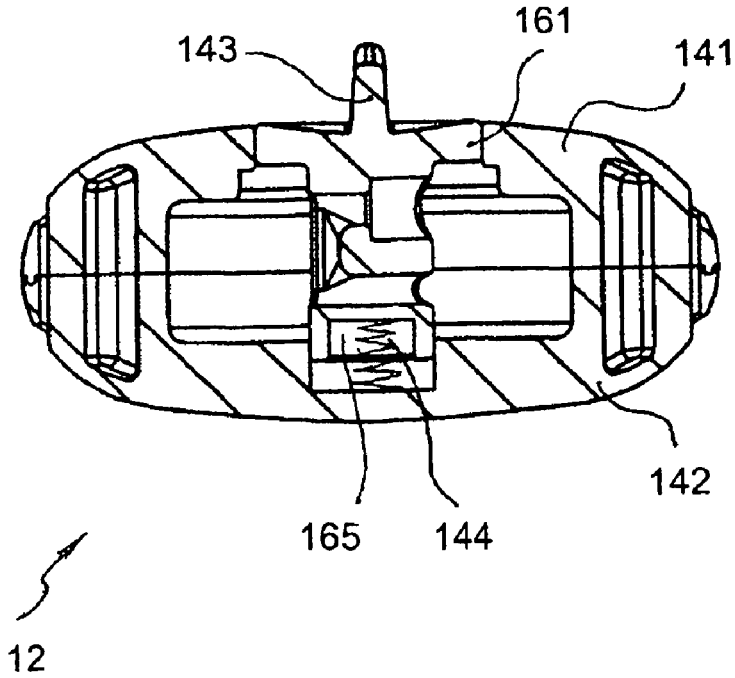

FIG. 9: A dissected view of the cord handle and cord length adjuster in FIG. 5.

Figure 10:
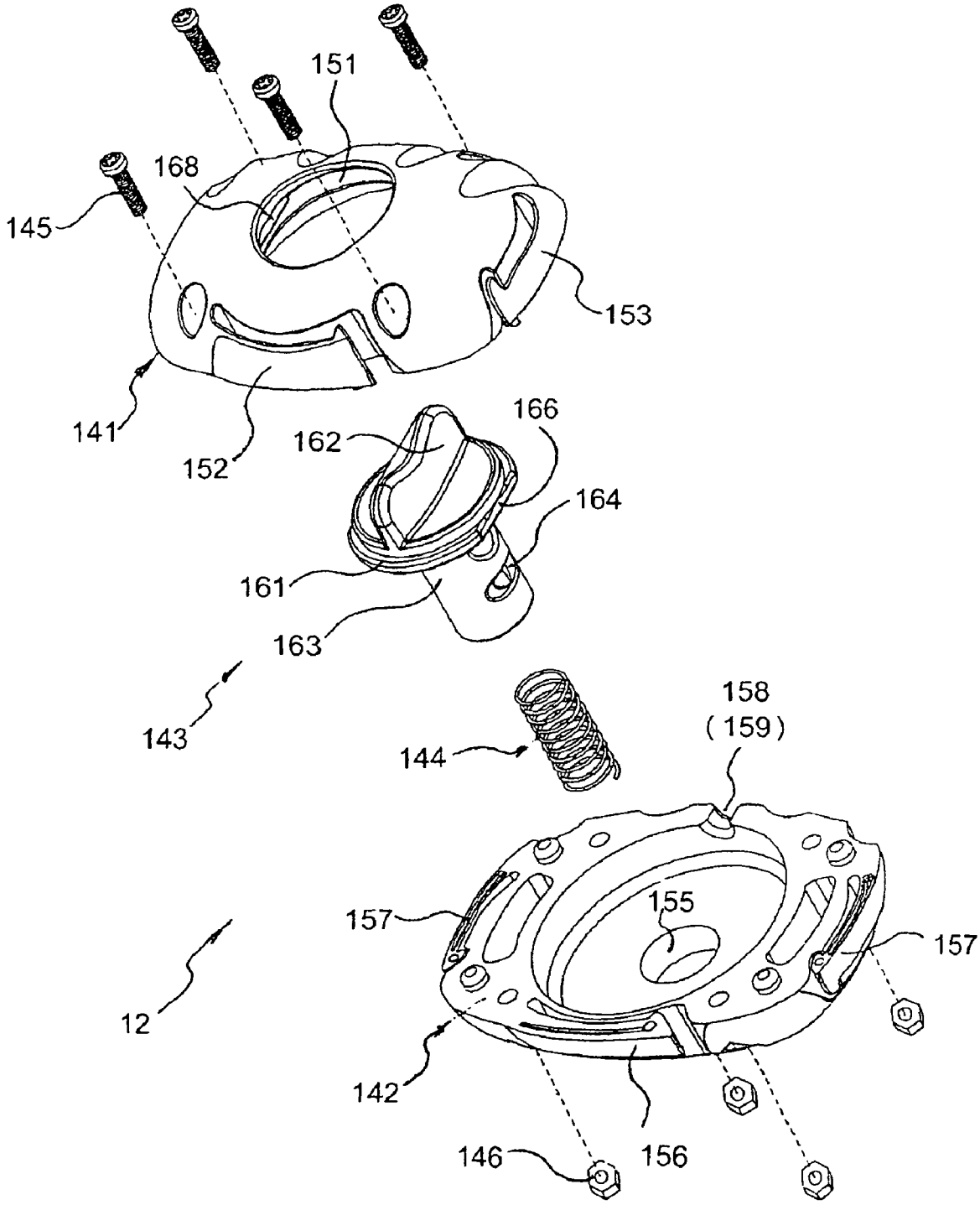

FIG. 10: An exploded perspective view of the cord handle and cord length adjuster in FIG. 5.

Figure 11A:
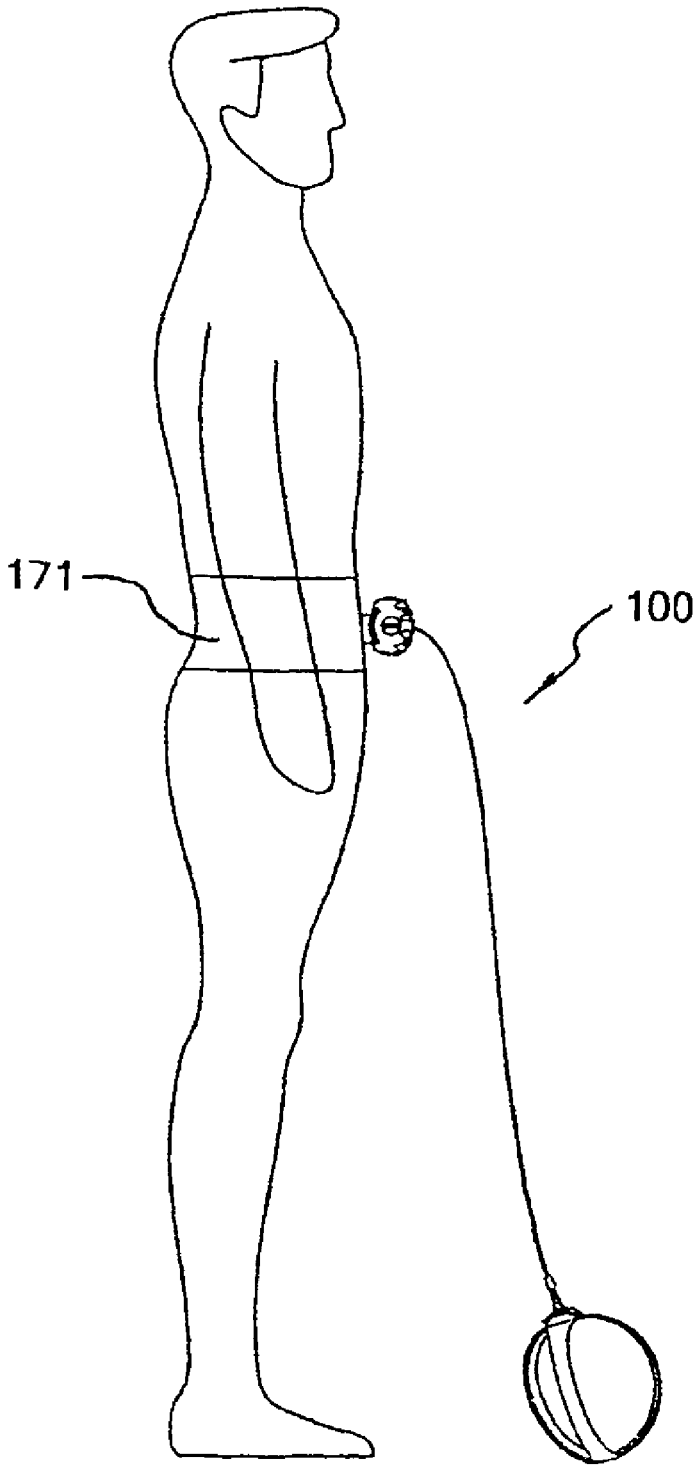

FIG. 11A: An application of this ball training apparatus invention.

Figure 11B:
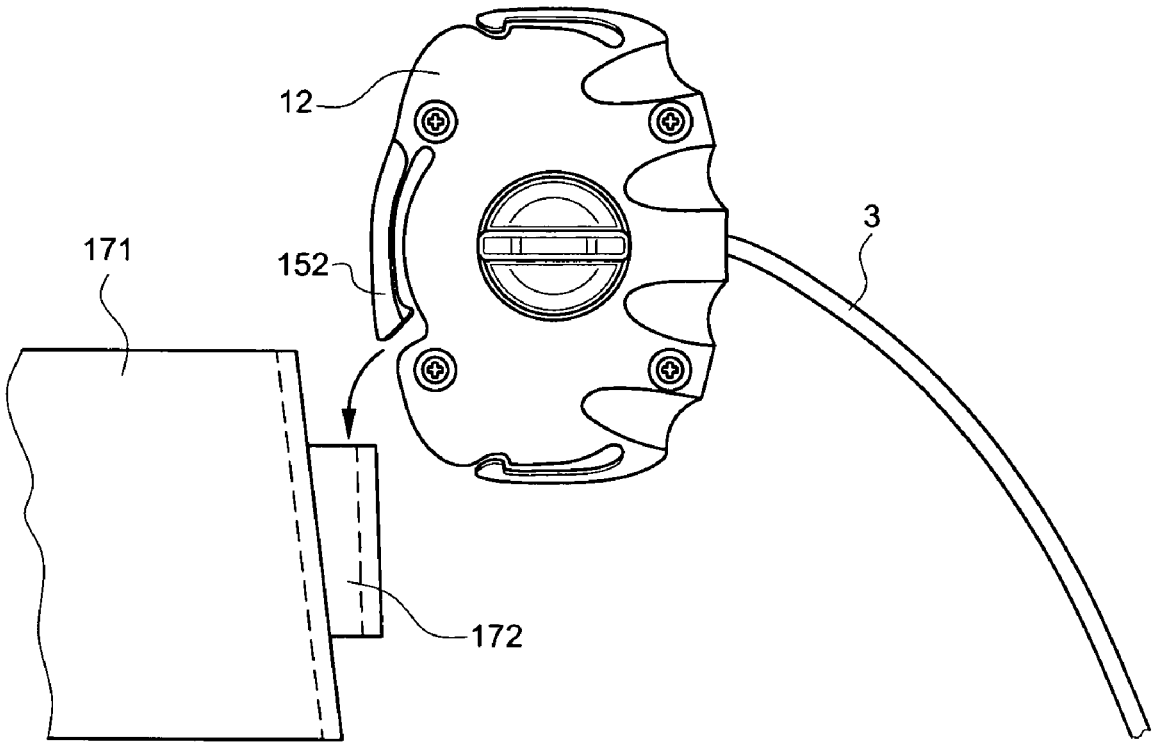
Figure 13A:
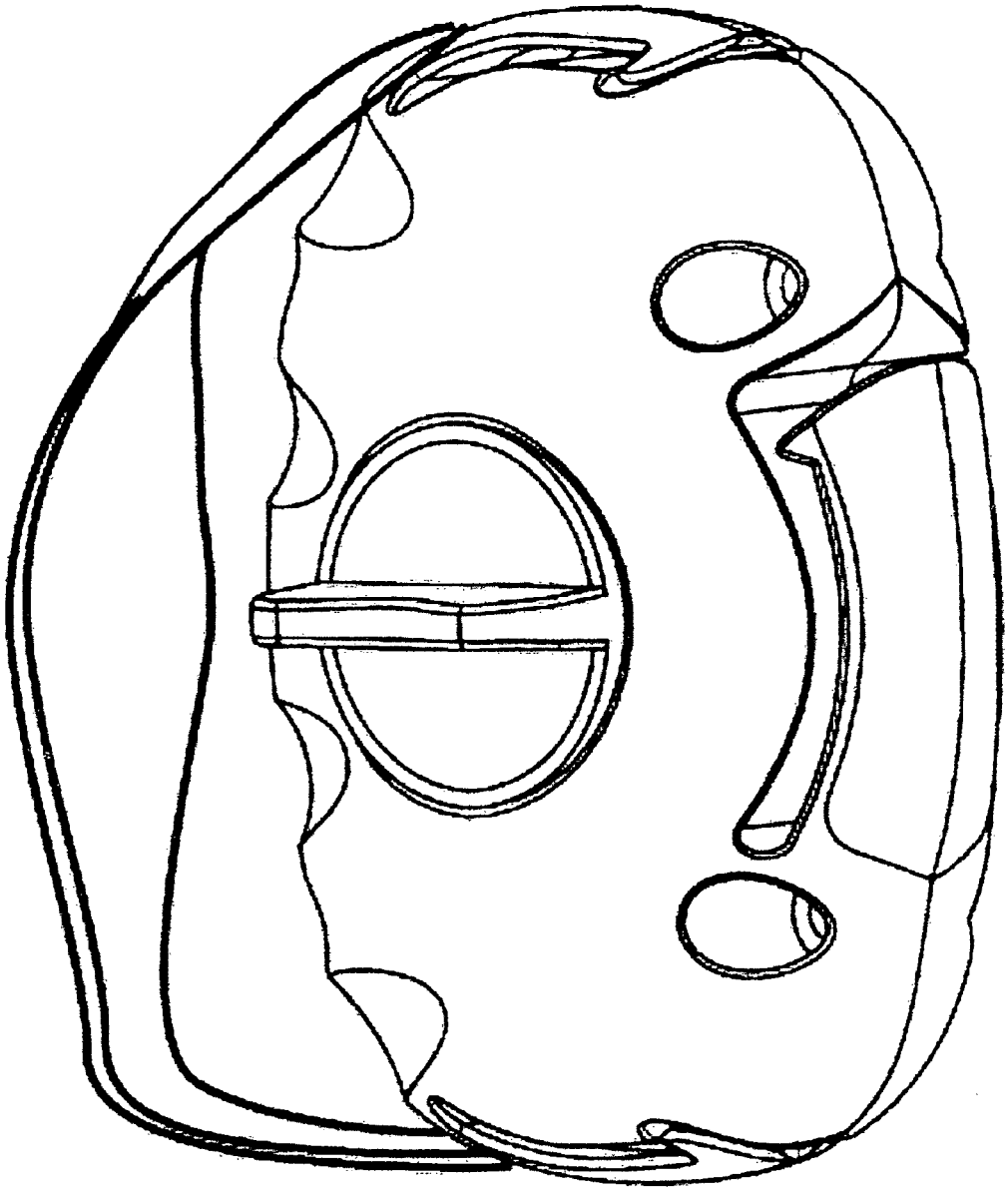
Figure 13B:
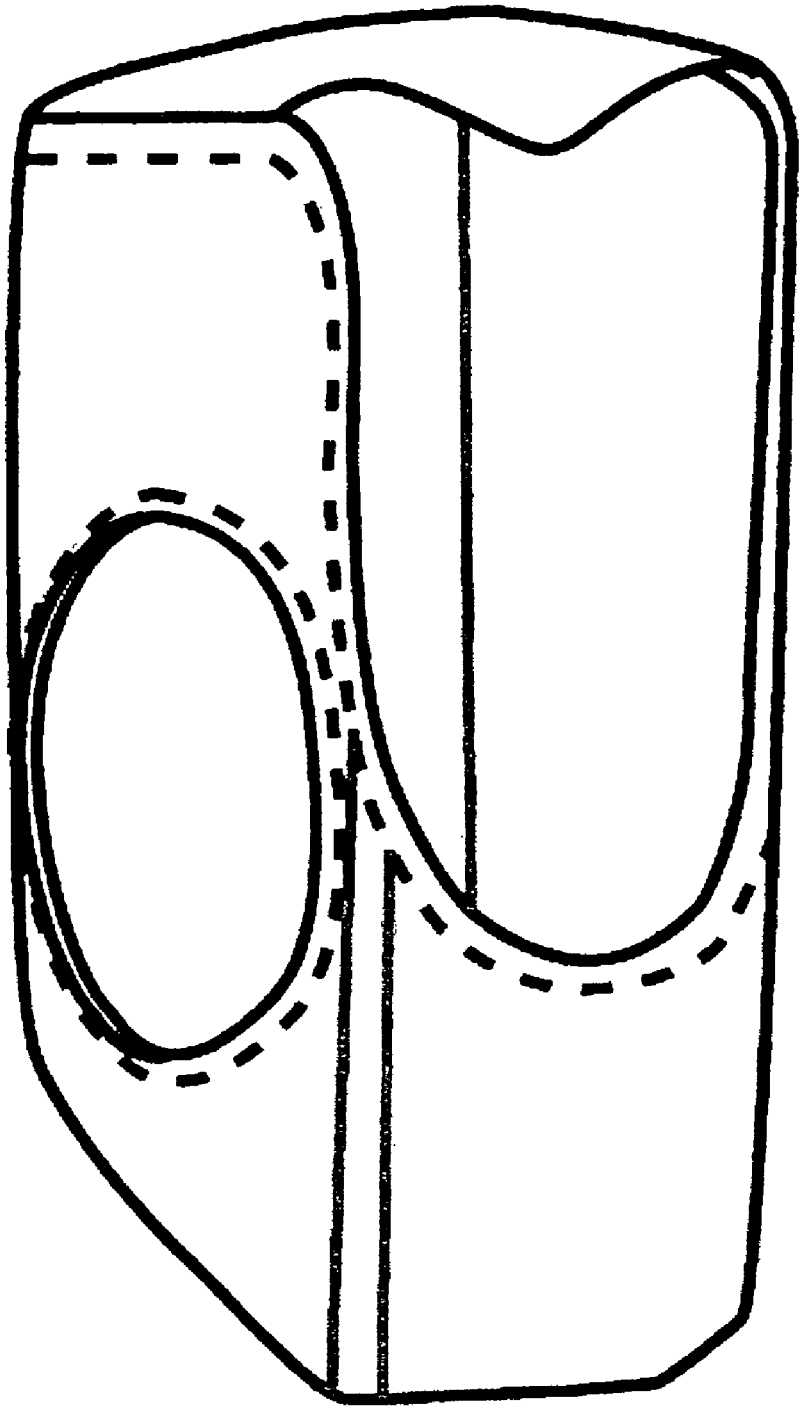
Figure 13C:
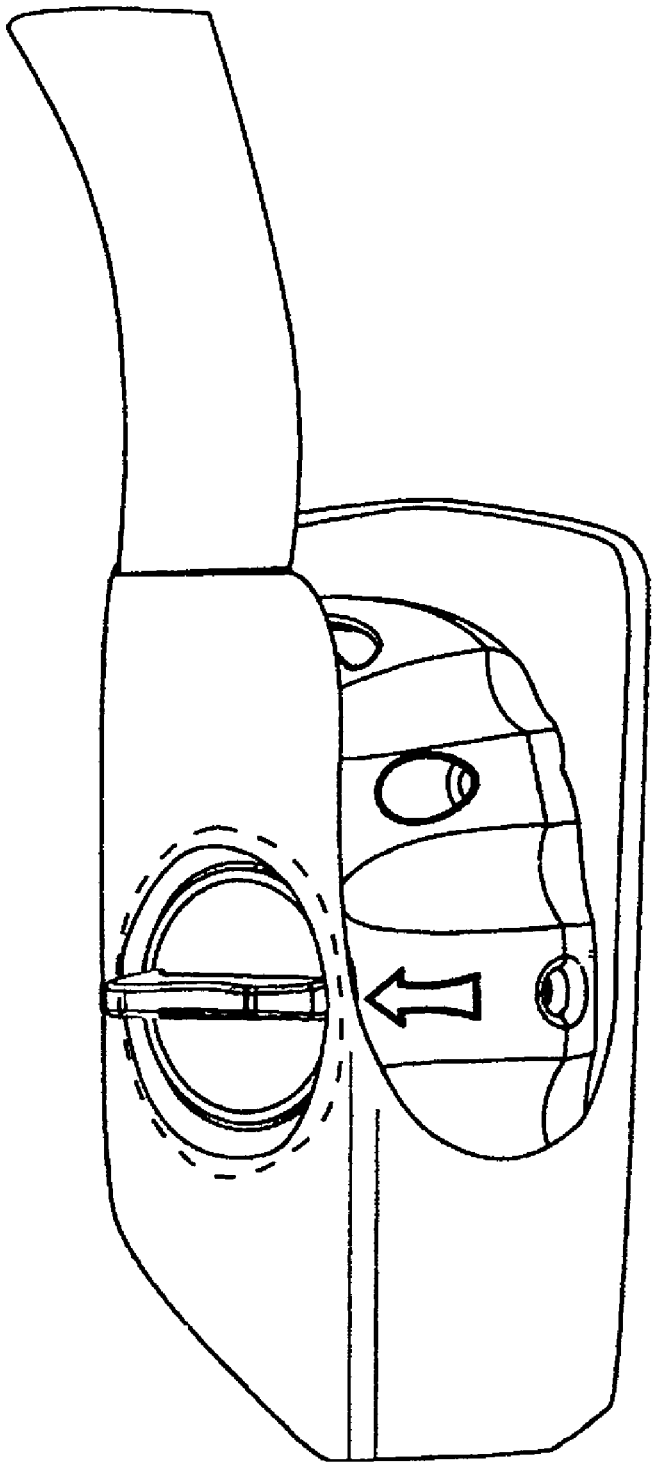
Figure 13D:
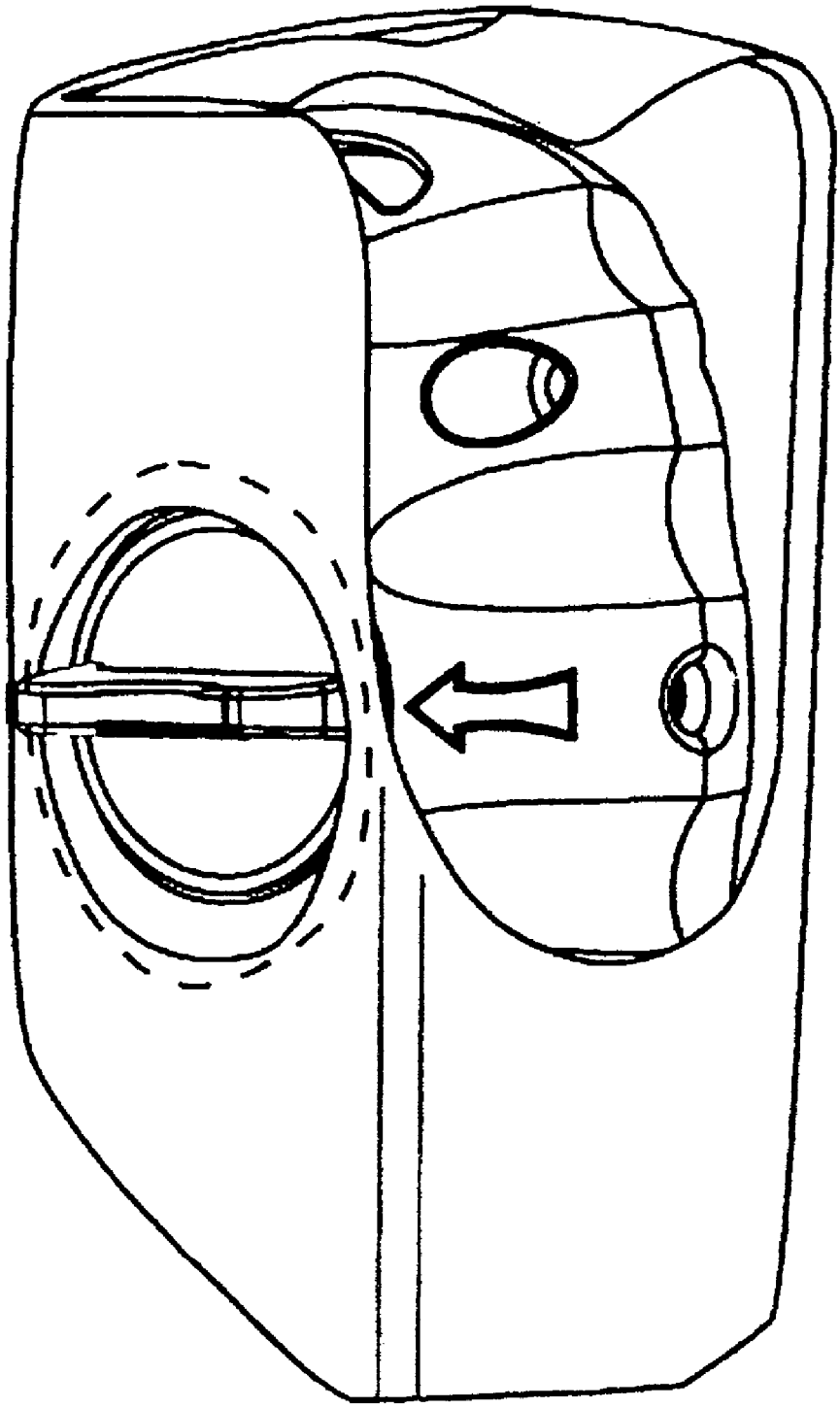
Figure 13E:
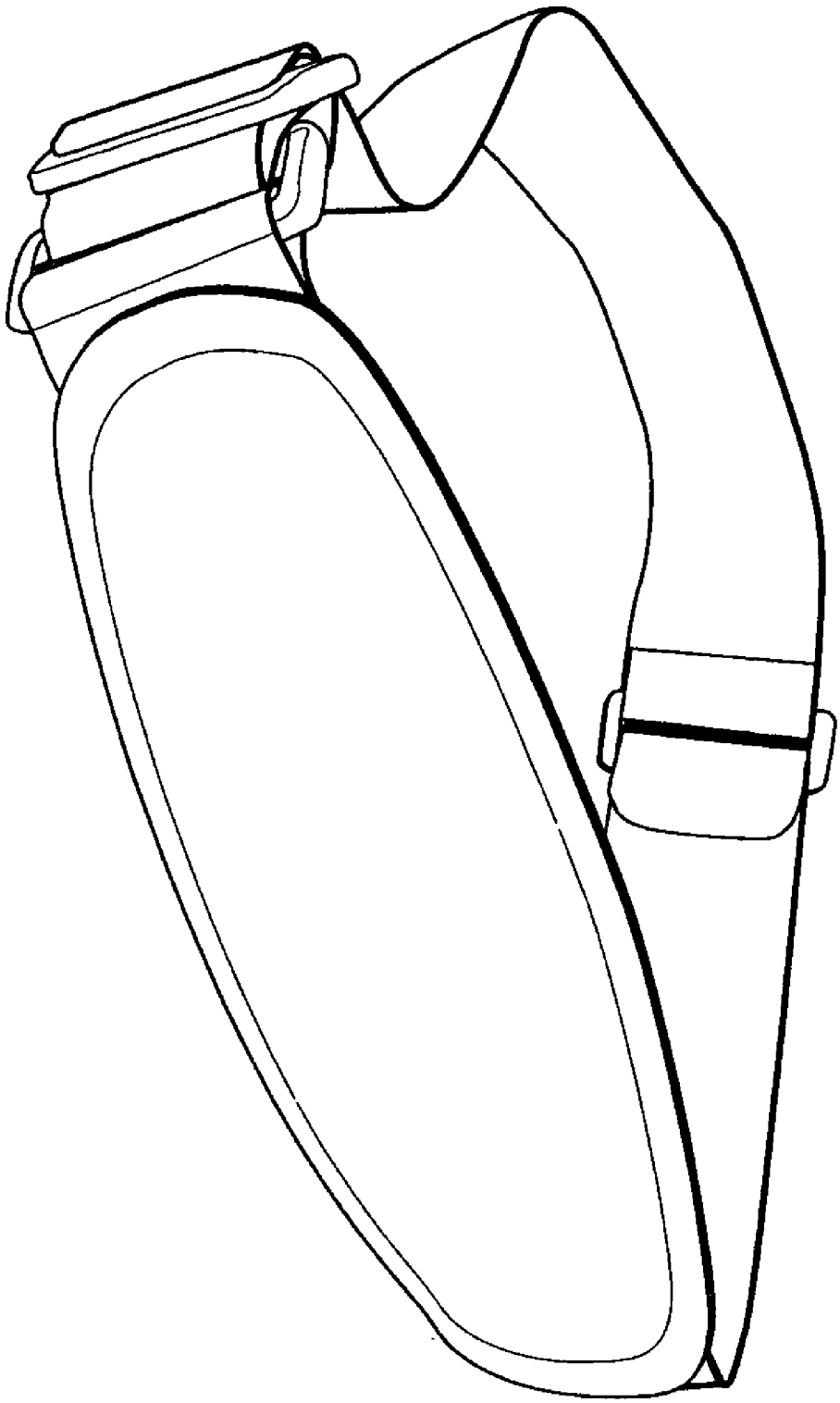
Figure 13G:
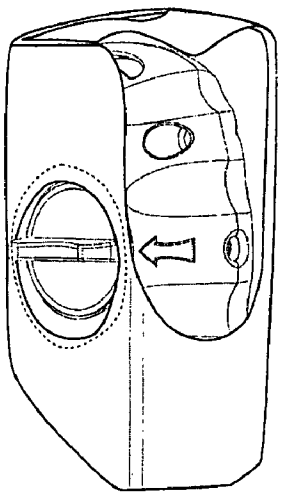
Figure 13F:
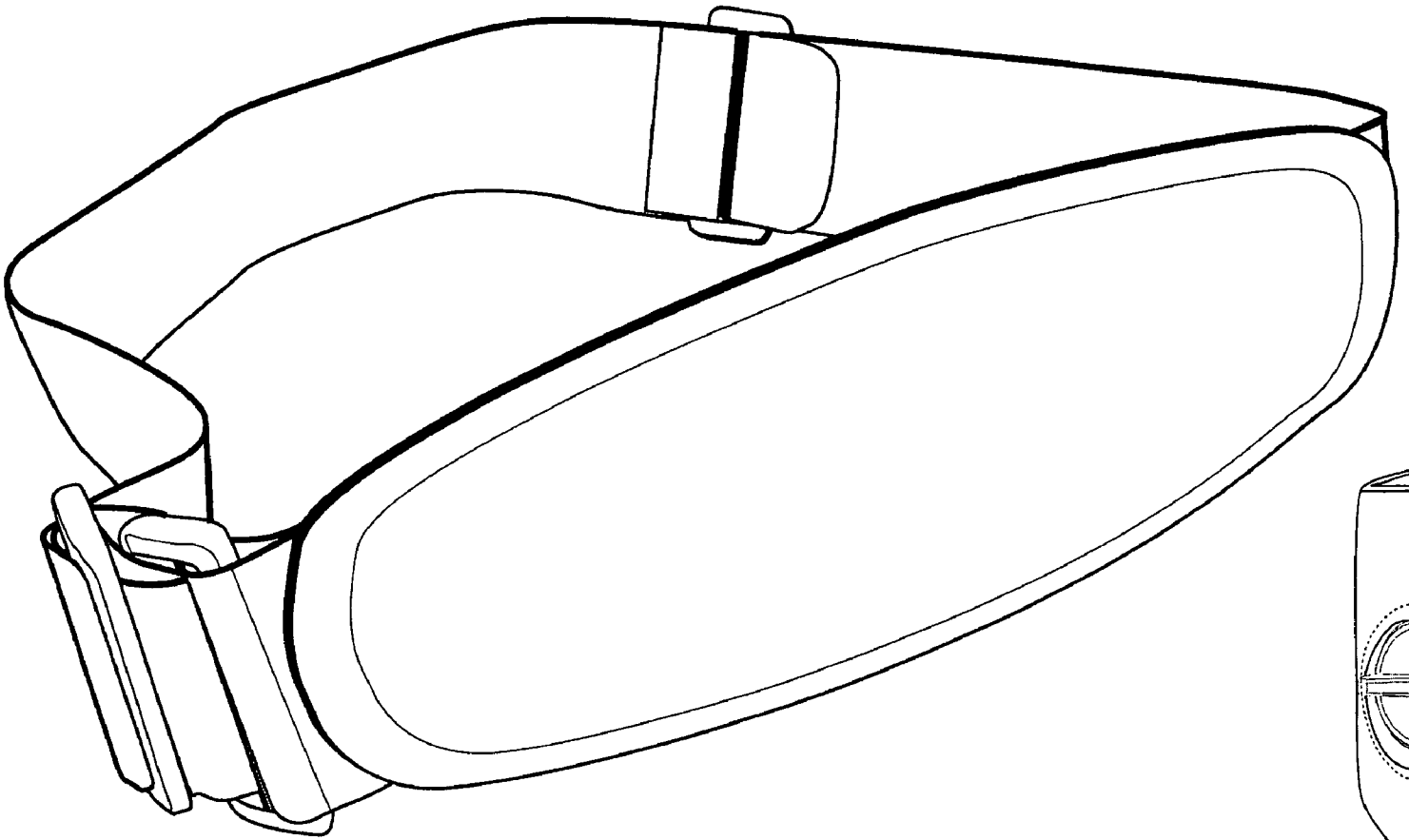
Figure 13I:
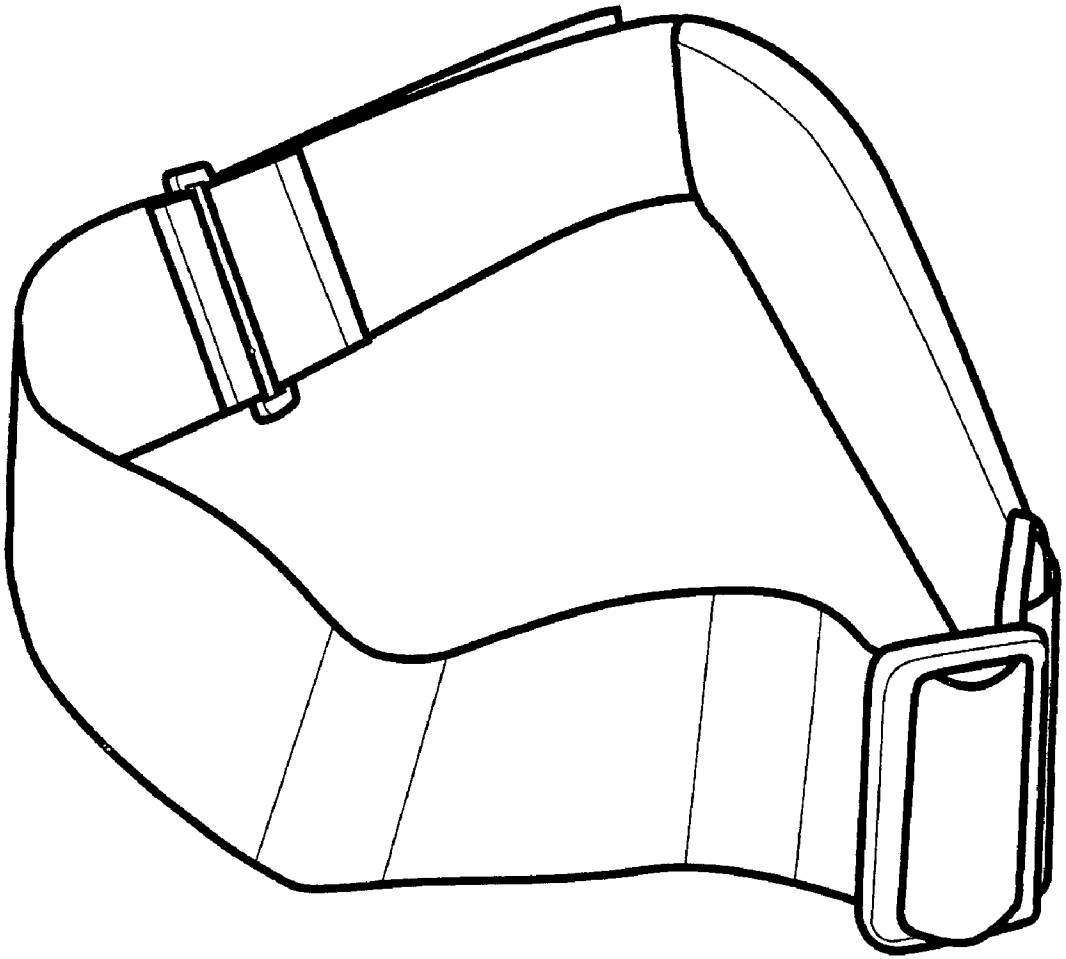
Figure 13H:
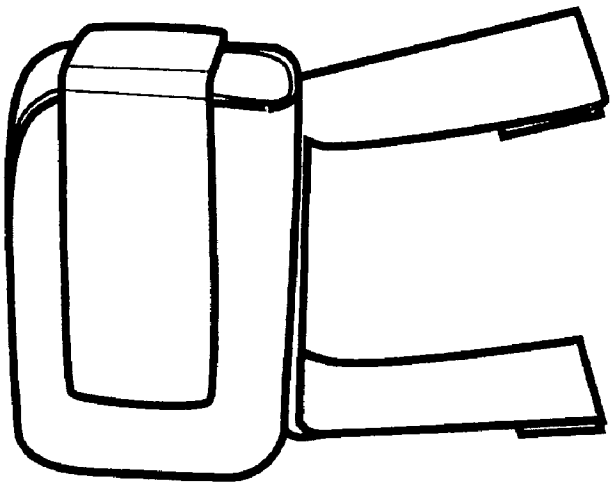
Figure 13J:
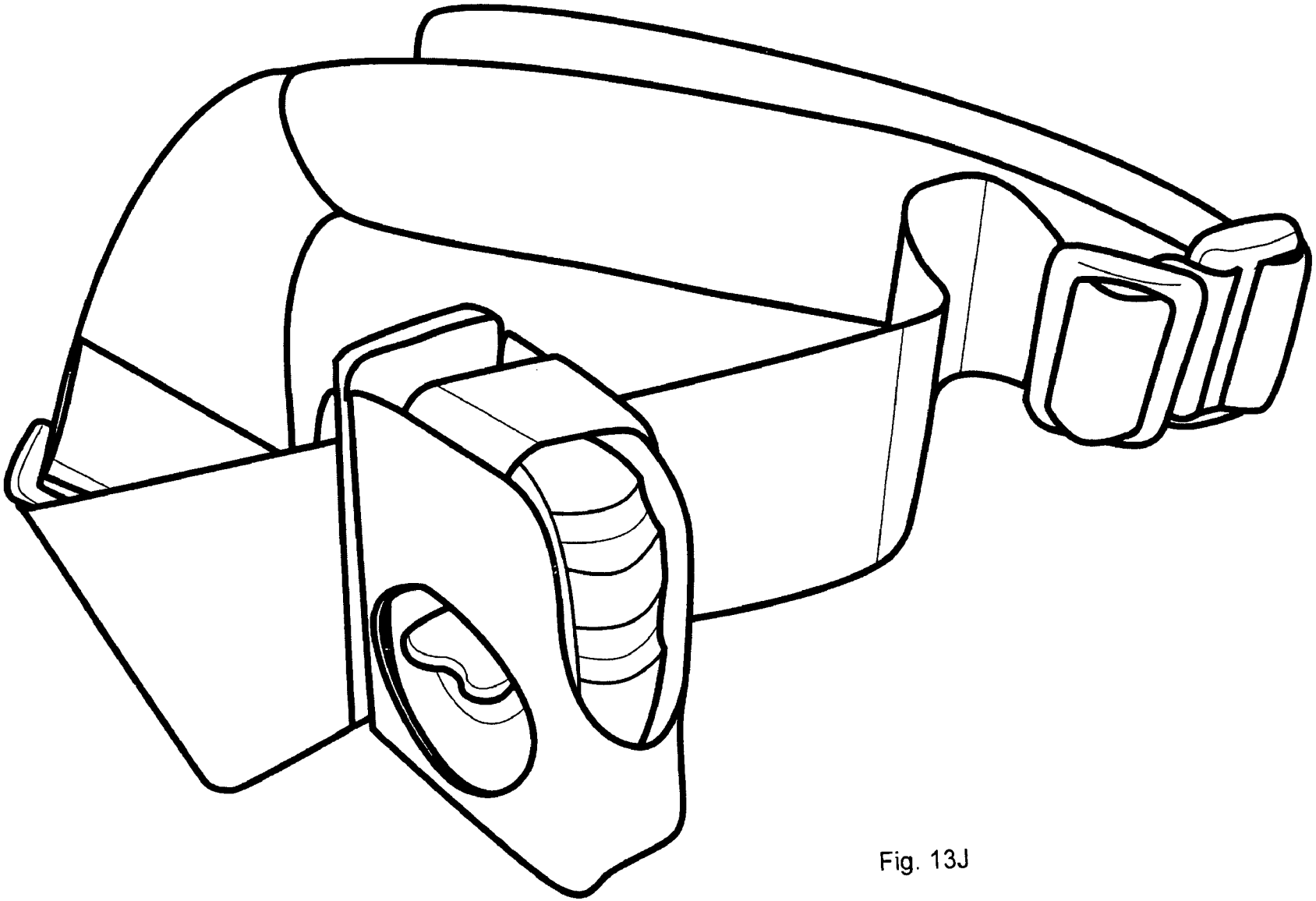
Figure 13K:
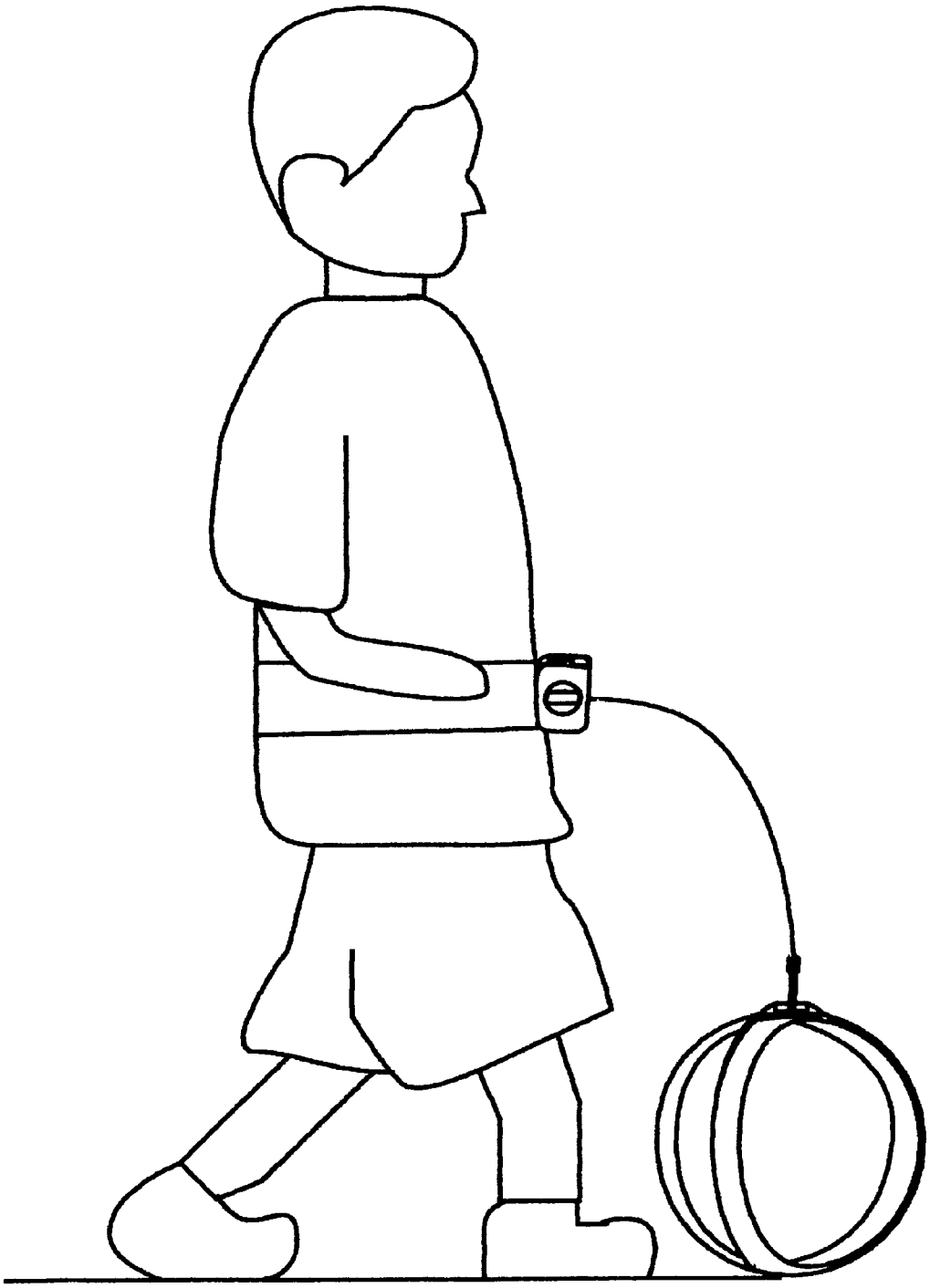
Figure 13L:
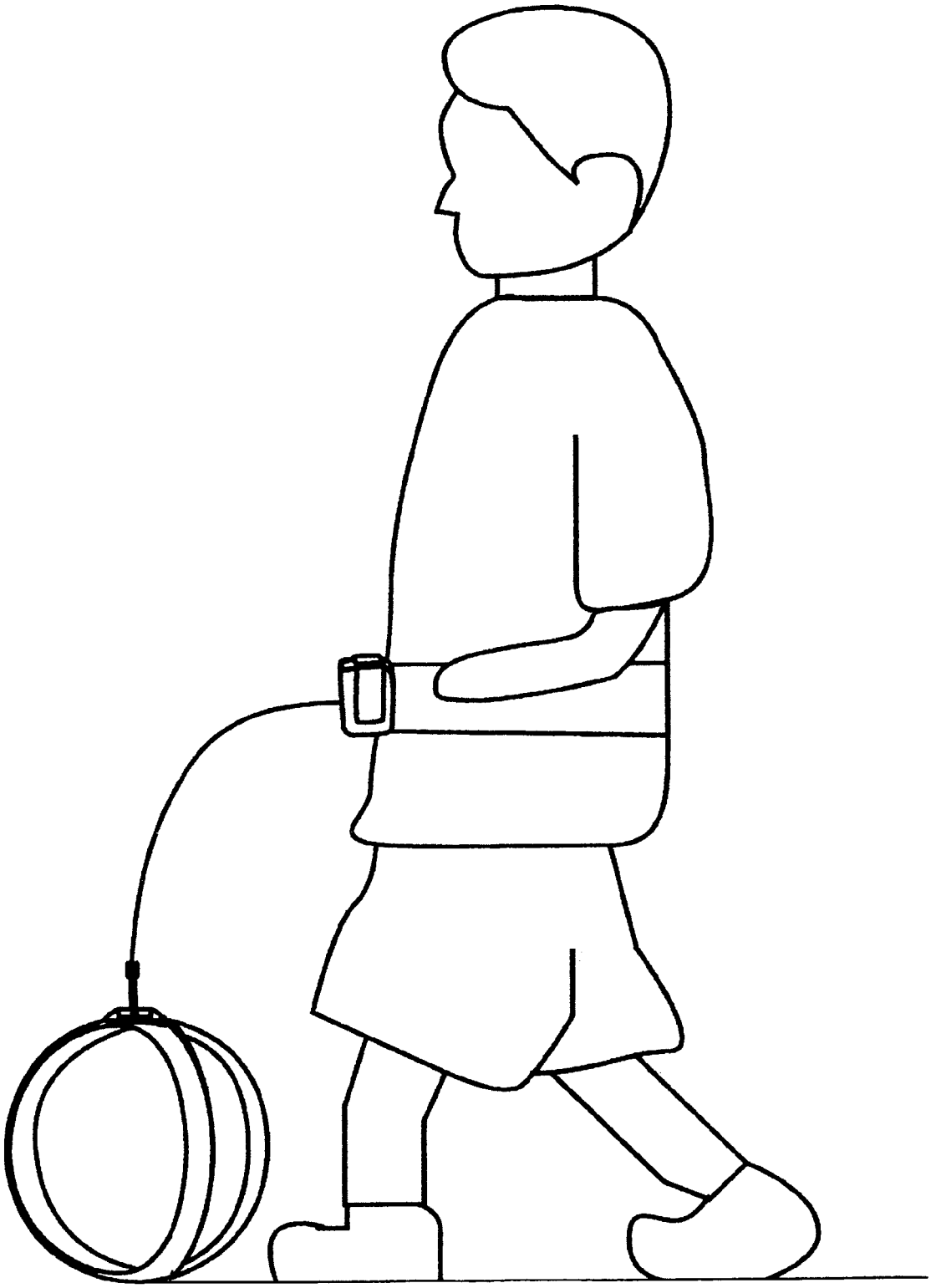

FIG. 11B: One alternate view of FIG. 11A.

Figure 12:
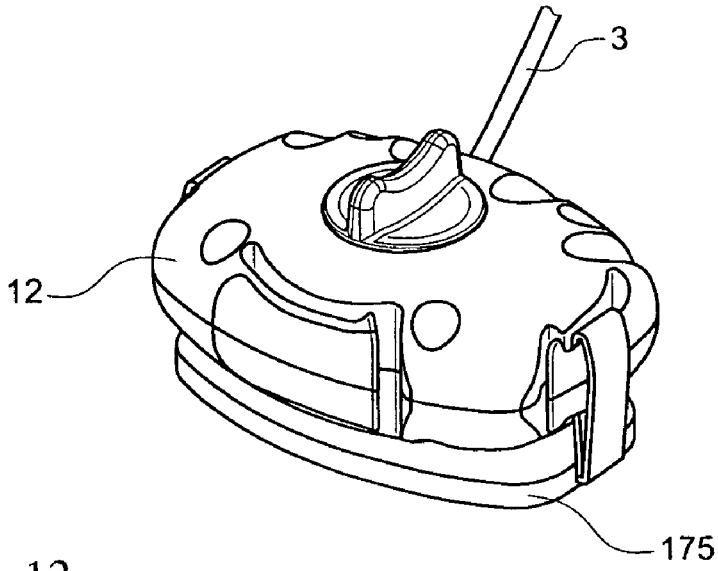

FIG. 12: An illustration of a case when the cord handle and cord length adjuster can be held in hand.

FIGS. 13A-L: Illustrations of various aspects of the application of the invention including a waist belt.

DETAILED DESCRIPTION OF THE INVENTION

Please refer to FIG. 1, FIG. 2, FIG. 3 and FIG. 4. FIG. 1 shows a three dimensional dissembled view of a first implementation of the ball training apparatus of this invention. The ball training apparatus 10 includes a ball 1, a ball-holding net 2, a cord 3, a cord length adjuster 4, a cord handle 5, and a spinning connector structure 6

The ball 1 can be of various sizes and shapes.

The ball-holding net 2 is made from elastic material. It is stretchable so that it can change the length to fit different sizes of the ball. It has at least 3 longitudinal strips 21. They form a ball holding space 23. When the ball is placed inside, since the strips are elastic, they will be bound to the surface of the ball. Thus the ball 1 is firmly stationed inside this space 2. There is a hole 22 on the junction of the strips on the top (north pole). Its top diameter is smaller than the bottom diameter. Thus it becomes a cone shaped space, which will allow the spinning connector structure 6 to fit in.

The cord 3 is often made from elastic material, but this is not necessarily the case. Elastic material will be stretched upon the pulling force on the cord and will bounce back.

Please also refer to FIG. 4 for a preferred embodiment of the invention. Cord length adjuster 4 can be made from plastic. Cord 3 can be made from elastic or non-elastic material. The adjuster has openings on both ends. In the inside of the adjuster, there is manual locking device 41, which splits the internal space of the adjuster into 3 compartments 42. One end of cord 3 enters knot 4 from the lower opening 43 and goes out from upper opening 421. The cord then passes through the D-shaped handle 7, goes down into another upper opening 422 to enter into knot 4 again. Then it runs into compartment 423 and mounted to the adjuster via mounting device 8. Using this device, knot 4 can move upon cord 3, and lock the location of knot 4 on the cord 3 by using manual locking device 41, so as to adjust the length of the tether.

Please refer to FIG. 3, also. In this embodiment, the other end of cord 3 connects to the ball-holding net 2 via a removable spinning connector 6. The end of cord 3 is wrapped with rubber hose 65. Its tip is mounted to a round metal piece (not shown in the figure) to form a U-shape and plugged into an elastic vibration reduction cover 62 and spinning connector 61. The elastic vibration reduction cover 62 is mounted on the spinning connector 61. The spinning connector 61 is embedded into the round washer 63, and uses round bottom 64 to seal the bottom to form a empty space. The spinning connector 61 can spin inside this space. Once assembled, the spinning connector structure 6 will be placed into the flat head cone-shaped space in the north-pole hole of the ball-holding net 2. Pushing the round washer 63 of the spinning connector into this flat head cone-shaped space, and the cord 3 and the ball-holding net will be connected. Since spinning connector 61 can rotate freely in the space formed between the round washer 63 and the round bottom 64, and ball-holding net 2 is connected to the washer 63 of the spinning connector device 6, the ball-holding net can spin freely without causing the cord 3 to intertwine. Thus this invention provides a method to let the ball-holding net to spin freely without intertwining the tether, and resolves the problems current practice balls have in the design and usage.

Please refer to FIG. 5 through 10. FIG. 5 the three dimensional dissembled view of a second implementation of the ball training apparatus of this invention. Same numbers are used to identify components having the same functions as in the first implementation. The ball training apparatus 100 includes a ball 1, a ball-holding net 2, a cord 3, a cord length adjuster 4, a spinning connector structure 11 and a cord handle and a cord length adjuster 12.

The ball 1 can be of various in size and shape.

The ball-holding net 2 is made from elastic material. It is stretchable so that it can change in length to fit different sizes of the ball. It has at least 3 longitudinal strips 21. They form a ball holding space 23. When the ball is placed inside, since the strips are elastic, they will be bound to the surface of the ball. Thus the ball 1 is firmly stationed inside this space 2. There is a hole 22 on the junction of the strips on the top (north pole). Its top diameter is smaller than the bottom diameter. Thus it becomes a cone shaped space, which will allow the spinning connector structure 12 to fit in. This illustration shows that the ball-holding net is made by 3 elastic longitudinal strips but this ball training apparatus is not limited on that configuration. It can be done by either three or a number of elastic strips.

FIG. 6 is a dissected view of the spinning connector structure of the second implementation of the ball training apparatus of this invention. FIGS. 7 and 8 are the perspective view of the cord handle and cord length adjuster and the perspective view of the elastic vibration reduction cap respectively.

FIG. 6 illustrates that the spinning connector structure 11 is composed of a ring-shaped washer 113, a spinning connector 114 installed in the ring-shaped washer 113 which can spin in relative to the ring-shaped washer 113, an elastic vibration reduction cap 115 installed on the spinning connector 114, and a round base cap 116 permanently sealed at the bottom of the ring-shaped washer 113. The ring-shaped washer 113 has both flat head cone-shaped surface 118 and cylindrical-shaped surface 119 with relatively smaller diameter. It tightly fits inside the opening 22 of the flat head cone-shaped space of the ball-holding net 2. The cylindrical-shaped surface 119 protrudes the opening 22. The ring-shaped washer also has a concave round bottom 120.

FIG. 7 illustrates a round disk 122 at the bottom of the spinning connector 114. It is installed in the concave round bottom 120 of the ring-shaped washer 113 in a way so that it can rotate relative to the ring-shaped washer 113. There is a cylinder 123 on the round disk 122. Cuts are made on each parallel side of cylinder 123 to form a shape resembling a twin-fan shaped structure 124. On cylinder 23, and close to the round disk 122, there is a passage 125 perpendicular to the central axis of cylinder 123. Also an arc groove 126 is cut down one side of the twin-fan shaped structure 124, tangential and passable to passage 125. A ring buckle 31 (refer to FIG. 5) on one end of the cord 3 can insert through the arc groove 126 and stay in passage 125 to clip on and hold to the spinning connector 114. Concave grooves 127 are cut on both remaining circular sides of the twin-fan structure 124 to be clipped and connected to the elastic vibration reduction cap 115.

FIG. 8 illustrates a pair of flat wing shaped extenders 132 from flat cylinder 131 on the elastic vibration reduction cap 115. A concave bottom 133 is formed at the bottom of the flat cylinder 131, coordinating with the contour of the twin-fan shaped structure 123 and the concave groove 126 on the spinning connector 114. There are two cord passages 136 on top of the flat cylinder 131. After passing through one of the openings 136, the cord 3 exits from another opening 136 and forms a ring buckle 31 (see FIG. 5). After being set up the spinning connector 114 and the ring-shaped washer 113 are tightly buckled in the opening 22 of the ball-holding net 2, the twin-fan shaped structure 124 then rose out of the opening 22. Therefore the ring buckle 31 on one end of the cord 3 can stay in the passage 125 of the spinning connector 114, after being inserted through the arc groove 126 on the spinning connector 114. After that the elastic vibration reduction cap 115 is attached to the spinning connector 114, aligning its concave bottom 113 as well as the raised arc 134 with the spinning connector 114. The elastic vibration reduction cap 115 is preferably made of soft rubber or elastic plastic material. Its flat contour and its elastic buffer can protect a user from the force carried by the ball-holding net 2 when it bounces back. This remains a very important feature of this invention.

FIG. 9 is a dissected view of the cord handle and cord length adjuster on the ball training apparatus of the second implementation of this invention. FIG. 10 is its exploded perspective view. In this embodiment, the cord handle and cord length adjuster includes the following: an upper half 141, a lower half 142, a turn axle 143 installed on the upper half, a pressure spring 144 installed between bottom part of the turn axle 143 and the lower half 142, as well as screws 145 and nuts 146 fastening the upper and lower halves. In the middle of the upper half 141 there is an opening with step notches 151. There is a pressure clip 152 on the upper half. There are also two pressure clips 153 on both flanks of the half. There is a half hole (not shown) where the bottom of the upper half meets the lower half 142. There is a hole 155 in the middle of lower half 142. There is a pressure clip 156 on its top. Also there are two such clips 157 on both flanks. A half hole 158 exists where the lower half meets the upper half 141. Together with the half hole on the upper half 141 (not shown), they form a passage 159 for cord 3. The turn axle 143 features a step flange 161. It is installed in the step hole 151 on the upper half 141. The axle also features a turning knob 162 located above the flange 161 as well as a take spool 163 below the flange. There is a hole 164 for tying the cord on the turn axle 163. At the bottom of the axle there is a concave hole 165. A pressure spring 144 is installed between the concave hole 165 on the axle and the hole 142 on the lower half. After passing the turn knob 162 of the turn axle 143 through the step opening 151 on the upper half 141, the flange 162 on the axle can be turned in relative to the step opening 151 of the upper half 141. A level notch 166 has been cut out on the large circle of the flange 162 of the axle 143. As spring pressure pushes the flange 162 on the axle 143 towards the step opening 151 on the upper half 141, the level notch 166 on the flange 162 engages the stop notch 168 in the step opening 151 of the upper half 141. The turn axle is not able to turn then. As the turn knob 162 is pushed inward by hand, the level notch 166 on the flange 162 disengages with the stop notch 168, the knob 162 can be turned both clockwise and anti-clockwise by hand. This allows the cord 3, passed through the passage 159 between the upper and lower halves, to be wound or unwound on the turn axle 163. Thus the length of the cord 3 connecting the cord handle and cord length adjuster 12 and the spinning connector structure 11 can be adjusted. Because of its simplicity of structure, this cord handle and cord length adjuster of this illustration is easier to operate. It is appropriate for people of various ages.

The length and thickness of the cord can vary, depending on the needs of the user. Cord 3 can use non-elastic material. If the cord is non-elastic, the movement of a ball is more predictable, and a user has more control over the ball training apparatus. This uses simple training tactics and is appropriate for beginners to practice various ball movements. Conversely if elastic material is chosen for the cord 3, then different forces of forward or backward movement can be created because of the elasticity, depending on the force from a user (a player) in serving the ball. This is suitable to raise training difficulty and enhance interest in training at the same time.

As shown in FIG. 5, an end of the cord 3 passes through two passages 136 on the elastic vibration reduction cap 115 and forms a ring buckle 31. Cord 3 is fixed on cap 115, so that it is not easy to disconnect. But since the cap 115 can be disengaged from the spinning connector 114, and since the special structure of the arc groove 126 and the passage 125 on the spinning connector 114, it is easy for the ring buckle 31 to be engaged or disengaged from the spinning connector 114. Thus changing the cord 3 in this invention is easy. For example, in order to achieve quicker responses, cord material of higher elasticity or of thicker diameter can be chosen.

This ball training apparatus can have at least two applications.

FIGS. 11A and 11B demonstrate the cases when the cord handle and cord length adjuster 12 are attached to a user's waist belt. A strength enhancing ring 172 can be sewed on a user's waist belt 171. The cord handle and cord length adjuster 12 can be clipped on the ring 172 using the pressure clips 152 and 156, to fix it on to the belt 171. This application provides two applications for users. The first choice can be for a goalkeeper. He or she can throw the ball from one of three positions. For example, the ball can be thrown both over the head and by the chest using both hands. Or use one hand throws the ball from around the waist belt. Or using both hands and legs, kick the ball, depending on the selective force on the foot and the chosen angle of the foot, and take the ball back with both hands. This training is especially appropriate for enhancing skills of a goalkeeper. A second choice is when a user applies only his feet to kick and control the ball movement, without holding the hand piece in hand when exercising.

FIG. 12 illustrates the case when the cord handle and cord length adjuster 12 is held in hand. In order to enhance the reliability when the cord handle and cord length adjuster 12 is hand held, an elastic protective belt 175 can be inserted into the pressure clips 153 and 157 on both flange of the cord handle and cord length adjuster 12. This application differs the choice of attaching the cord handle and cord length adjuster 12 to a user's waist belt in that it offers different ball control. For example, when the cord handle and cord length adjuster is hand held, the ball movement can be effected by the position of the hands. And the bounce back motion of the ball after been kicked can be controlled with hands. This requires higher skills in training when the hand retaining the handle is in a fixed position & not moving.

Certain embodiments of the invention include a waist belt and can also include a pouch which serves the purpose of a carrying case to contain the handle for the practicing the hands free feature of the training device (See FIG. 13A-13L) The waist belt can include a feature to make it fully adjustable to fit a small waist of a child or a larger waist of an adult. The waist belt can also be made in different sizes to accommodate particular sized waists in inches or centimeters. The waist belt can also be made to accommodate or adjust to certain ranges of wait sizes, i.e, ranges of extra small, small, medium, large, extra large, extra extra large, etc. The materials the belt is comprised of can be a durable type & can offer padded protection at the back of the waist belt for comfort through continuous play (See FIG. 13E).

The waist belt can contain features for adjusting the belt and these can be located at the front of the belt or any convenient location. In certain embodiments, for the users convenience there are (2) ways in which to adjust the belt. The first being the major adjustment of the length of the belt which can use a means of adjustment such as Velcro to affix the end of the belt to the belt strap. The clip may be rectangular and may be made of plastic and secured to the belt. The second adjustment can be a fine adjustment which the user slides another plastic rectangular shaped clip containing the belt straps in either direction to loosen or tighten the belt at their discretion. (See FIGS. 13I and 13J).

In certain embodiments the waist belt can include a pouch that can act as a carrying case and can securely hold the handle of the tether cord during training. (See FIG. 13B). Combined together with the waist belt, this feature can allow the user of the training system to practice with hands free. (See FIG. 13J). The pouch case will safely & securely retain the handle so that the user does not have to control it when practicing with hands free. (See FIGS. 13D and 13J).

The carry case itself can have a ridged outer profile which can conform to the shape of the handle. This feature can be employed to minimize any movement of the handle within the case during hands free practice. The shape of the case is preferably chosen to allow for easy cord adjustment & free movement of the cord in any direction. For easy in & out access of the handle, the top of the case can remain open. The top of the case can be simply closed off retaining the handle within by, for example, by means of a Velcro strap.

Located on the back of the case are (2) straps. (See FIG. 13H). One is at the top & the other at the bottom. These two straps when overlapped & secured with the Velcro at the front of the waist belt will retain the case. (See FIG. 13J). The case for the convenience of the user when attached to belt can be adjusted by sliding the case along the waist belt in either direction to maintain a true center position.

What is claimed:

1. A ball training apparatus, comprising:

a ball-holding net that wraps around a ball;

a tether cord that is connected to the net;

a cord handle and cord length adjuster connected to one end of the said tether cord to adjust the length of the tether cord; and a spinning connector structure that is attached on the ball-holding net and connecting said ball-holding net to the tether cord, wherein the ball inside the net can rotate freely without intertwining with the tether cord, wherein said spinning connector structure comprises:

a ring-shaped washer having both a flat head cone-shaped surface and cylindrical-shaped surface with relatively smaller diameter than said flat head, said ring-shaped washer being attached from underneath a hole on the said ball-holding net, said ring-shaped washer having a concave round bottom; a round base cap that is seated beneath the said ring-shaped washer; and a spinning connector installed inside said ring-shaped washer, wherein a round disk is located at the bottom of the said spinning connector, wherein the said round disk coordinates the said concave round bottom so that it can spin freely inside said ring-shaped washer, and the top of the said round disk has a cylinder which is connected with said tether cord.

2. The ball training apparatus of claim 1, wherein cuts are made on each parallel side of the top part of the said cylinder of the said spinning connector, to form a shape resembling a pair of extending fans, wherein close to the said cylinder and the round disk there is a passage perpendicular to the central axis of the cylinder, wherein on the same part an arc groove is cut down one side of the fan shaped structure, the groove being tangential and passable to the said passage, a ring buckle being attached to one end of the cord, said ring buckle being inserted into said passage, and wherein concave grooves are cut on both remaining circular sides of the twin-fan shaped structure.

3. The ball training apparatus of claim 2, wherein said spinning connector includes an elastic vibration reduction cap attached to the top of the said spinning connector, said elastic vibration reduction cap having a flat cylinder and a pair of flat wing shaped extenders, wherein a concave base is formed at the bottom of the said flat cylinder, coordinating the contours of the said twin-fan shaped structure and said concave grooves on the said spinning connector, and wherein cord passages are bored on top of said flat cylinder.

4. A ball training apparatus, comprising:

a ball-holding net that wraps around a ball;

a tether cord that is connected to the net;

a cord handle and cord length adjuster connected to one end of the tether cord to adjust the length of the tether cord; and a spinning connector structure that is attached on the ball-holding net and connecting said ball-holding net to the tether cord, wherein the ball inside the net can rotate freely without intertwining with the tether cord, wherein said cord handle and cord length adjuster have an upper half and a lower half, a turn axle installed on the upper half, a pressure spring installed between a bottom part of the turn axle and the lower half, and screw fasteners to secure the two halves, wherein in the middle of the upper half there is an opening with gradual steps, wherein a stop notch is made in the opening, said turn axle having a flange in several gradual steps which is affixed inside the opening and can be turned around, wherein the turn axle features a turn knob on top of the flange and a take spool below the flange, one end of the said tether, after winding past a passage located at the meeting surfaces of the upper and lower halves, is tied and wound on the take spool, wherein when pushed by the pressure spring, the flange on the said turn axle reaches the opening with gradual steps until it is not able to turn there because of the stop notch.

5. The ball training apparatus of claim 4, wherein said cord handle and said cord length adjuster have a pressure clip on the front conjoining side of the upper and lower halves of the said cord handle and cord length adjuster, and said pressure clip is used to hook the said cord handle and cord length adjuster on a user's waist belt.

6. The ball training apparatus of claim 4, wherein said cord handle and cord length adjuster have pressure clips on both flanks of the two halves of the cord handle and cord length adjuster, and the pressure clips are used to affix an elastic band so a user can hold the said cord handle and cord length adjuster in hand.

* * * * *